United States Patent [19]

Gleadall

[11] Patent Number: 5,048,148

[45] Date of Patent: Sep. 17, 1991

[54] CARPET CLEANING APPARATUS

[76] Inventor: Robert Gleadall, 38818-15 Avenue, Edmonton, Alberta, Canada, T6L 2M4

[21] Appl. No.: 356,276

[22] Filed: May 23, 1989

[51] Int. Cl.[5] ..... A47L 5/34

[52] U.S. Cl. ..... 15/321; 15/315; 15/322; 15/353; 15/300.1

[58] Field of Search ..... 15/320, 321, 322, 300 A, 15/315, 353

[56] References Cited

U.S. PATENT DOCUMENTS

| | | | |
|---|---|---|---|
| 3,974,541 | 8/1976 | Silvis et al. | 15/320 |
| 4,156,952 | 6/1979 | Lynch | 15/321 X |
| 4,233,706 | 11/1980 | Kauffeldt | 15/300 A X |
| 4,244,079 | 1/1981 | Bane | 15/315 X |
| 4,475,264 | 10/1984 | Schulz | 15/300 A |
| 4,723,337 | 2/1988 | Ellison et al. | 15/353 X |
| 4,800,613 | 1/1989 | Blase et al. | 15/315 X |

*Primary Examiner*—Chris K. Moore
*Attorney, Agent, or Firm*—Michael Sand Co.

[57] ABSTRACT

A carpet cleaning apparatus consisting of a housing having a lower surface and an interior cavity. Wheels are secured adjacent to the lower surface of the housing. A conduit is secured to the housing. The conduit has a first end whereby the conduit may be coupled to a water supply and a second end with spray jets whereby fluids may be injected into a carpet. A discharge tank is secured within the interior cavity of the housing. The discharge tank has two suction ports, and two fluid inlets. Two suction conduits are provided. Each suction conduit has a first end communicating with one of the fluid inlets of the discharge tank and a second end disposed adjacent the lower surface of the housing. Two suction motors are secured in the interior cavity of the housing, each of the suction motors communicating with one of the suction inlets of the discharge tank such that a vacuum is created within the discharge tank and the suction conduits. Discharge fluids are drawn from the surface of a carpet via the suction conduits into the fluid inlets of the discharge tank.

5 Claims, 11 Drawing Sheets

CARPET CLEANING APPARATUS

The present invention relates to a carpet cleaning apparatus.

BACKGROUND OF THE INVENTION

Carpet cleaning apparatus generally consist of a base unit mounted on wheels containing a clean water reservoir, a discharge tank, a pump and a suction motor. A cleaning tool known as a "wand" is connected to the base unit by approximately thirty feet of flexible hose. The pump on the base unit is used to draw water mixed with chemicals from the clean water reservoir to the wand where the water is injected into the pile of the carpet. The suction motor is then activated to draw dirty water from the carpet to the discharge tank.

There are physical limitations on the amount of suction which can be delivered through a 1½ inch diameter hose to a wand by a small motor. For this reason persons skilled in the art have converted their service vehicles into base units which use the engine of the vehicle to deliver increased levels of suction. There are many applications, such as high rise buildings, where the use of these vehicle mounted units is not practical.

SUMMARY OF THE INVENTION

What is required is a carpet cleaning apparatus with an ability to create an increased level of suction.

According to the present invention there is provided a carpet cleaning apparatus which is comprised of a housing having a lower surface and an interior cavity. Means for moving the housing along a carpet are secured adjacent to the lower surface of the housing. A conduit is secured to the housing. The conduit has a first end whereby the conduit may be coupled to a water supply and a second end with spray jets whereby fluids may be injected into a carpet. A discharge tank is secured within the interior cavity of the housing. The discharge tank has a two suction ports, and two fluid inlets. Two suction conduits are provided. Each suction conduit has a first end communicating with one of the fluid inlets of the discharge tank and a second end disposed adjacent the lower surface of the housing. Two suction motors are secured in the interior cavity of the housing, each of the suction motors communicating with one of the suction ports of the discharge tank such that a vacuum is created within the discharge tank and the suction conduits. Discharge fluids are drawn from the surface of a carpet via the suction conduits into the fluid inlets of the discharge tank.

With the described invention the 30 feet of flexible hose and the "wand" are eliminated. The use of dual suction motors creates a suction force in the discharge tank far greater than could be created with any other configuration. The dual suction conduits overcome the physical limitations which arise from the use of a single suction conduit. Even more beneficial results may therefore be obtained if the two suction conduits are placed in a parallel configuration connecting with a single blade adjacent the lower surface of the housing to concentrate the suction force.

Although beneficial results may be obtained from using the carpet cleaning apparatus as described, there are limits to the size of clean water reservoir which can be mounted on a portable unit. As the size of the clean water reservoir is increased the apparatus becomes more difficult to maneuver. Even more beneficial results may therefore be obtained if the water supply source is a water supply hose which is adapted to be secured to a building water service.

Although beneficial results may be obtained from using the carpet cleaning apparatus as described, vehicular mounted carpet cleaning units can do a better job of cleaning carpets due to the pressures under which water may be injected into the carpet. These pressure are far in excess of the pressures obtainable through connection to a building water service. Even more beneficial results may therefore be obtained if a pump capable of producing water pressure in excess of 150 pound per square inch is interposed between the building water service and the water supply hose.

Although beneficial results may be obtained from using the carpet cleaning apparatus as described, there are limits to the size of discharge tank which can be mounted on a portable unit. As the size of the discharge tank is increased the apparatus becomes more difficult to manoeuver. Regardless of the size, the operator must stop periodically to empty the discharge tank. Even more beneficial results may therefore be obtained if the discharge tank is equipped with a fluid outlet and a sump pump whereby fluids in the discharge tank may be pumped out of the fluid outlet to a discharge hose which discharges into a drain of a building water service.

Although beneficial results may be obtained from using the carpet cleaning apparatus as described, chemical additives are needed to effectively perform some cleaning jobs. With the elimination of the clean water reservoir, chemicals can no longer be mixed into the clean water reservoir as previously was the case. Even more beneficial results may therefore be obtained if a chemical reservoir with a venturi valve is connected to the water supply hose whereby chemical cleaners may be added to the water supply.

Although beneficial results may be obtained from using the carpet cleaning apparatus as described, the teachings of the present invention result in an increase in the number of hoses and electrical power cables the operator must cope with. In prior art configurations the operator had to cope with a 30 foot vacuum hose and a single electrical power cable. With the present invention the operator must cope with several electrical power cables and with two hoses (a water supply hose and a discharge hose). This increase in the number of hoses and cables can become a disadvantage unless a simplified manner of handling the hoses and cables is developed. Even more beneficial results may therefore be obtained if the water supply hose, the discharge hose and any necessary electrical power cables are braided to form a single composite cable.

Although beneficial results may be obtained from using the carpet cleaning apparatus as described, the addition of the preferred features can make the system cumbersome unless all components are conveniently arranged. Even more beneficial results may therefore be obtained if a number of the additional preferred features are housed in an auxiliary unit. The auxiliary unit consists of a housing having an interior cavity. A pump capable of producing water pressure in excess of 150 pound per square inch is disposed within the interior cavity of the housing. The pump has an inlet and an outlet. A water connection hose having a first end communicating with the inlet of the pump and a second end adapted to be secured to a building water service is provided such that water is provided from the water service to the inlet. A hose and cable support is mounted within the interior of the housing, such that the braided composite cable consisting of the water supply hose, the discharge hose and any necessary electrical power cables may be wound around the support.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 10:
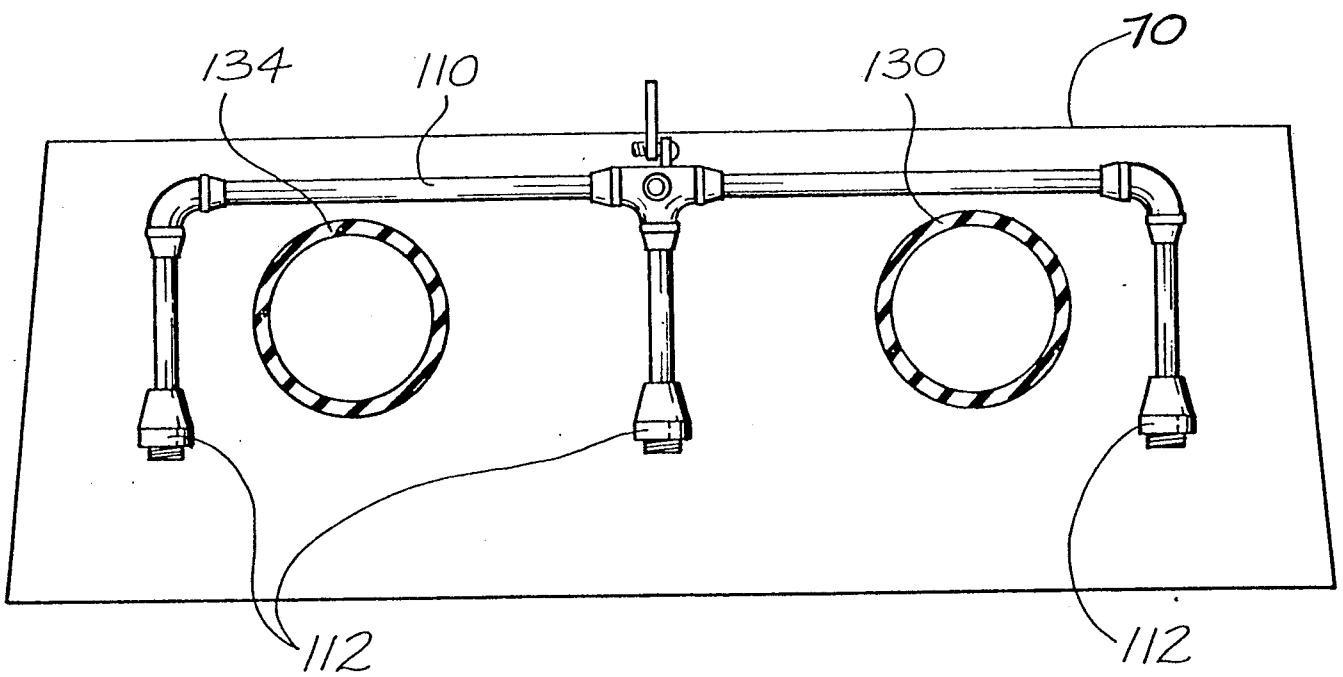
FIG. 10 is a section view of the carpet cleaning apparatus taken of FIG. 6.
Figure 11C:
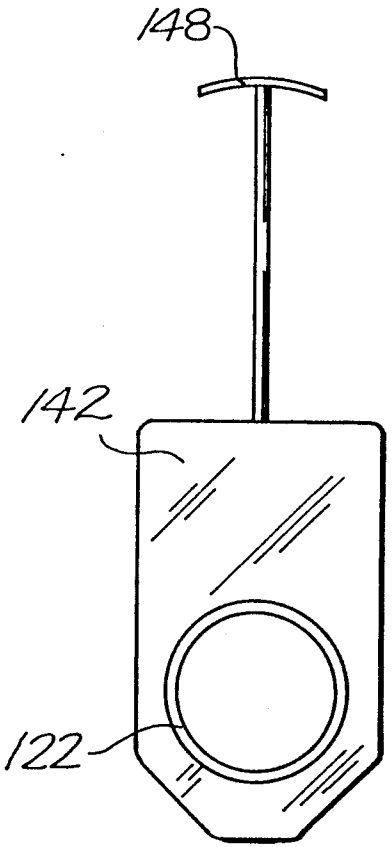
FIGS. 11*a, b* and *c* are identical detail views of a portion of the carpet cleaning apparatus illustrated in FIG. 8.
Figure 11B:
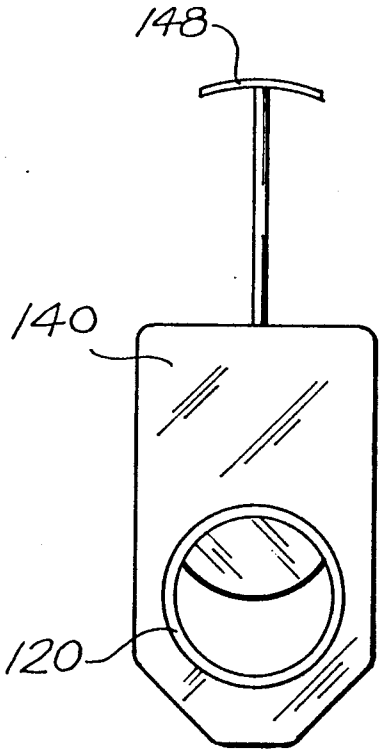
Figure 11A:
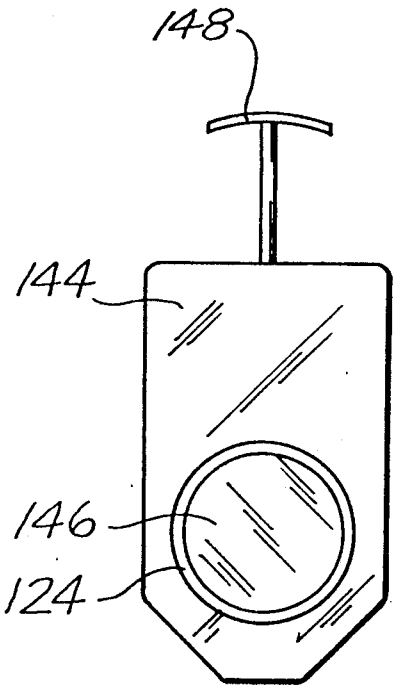
Figure 12:
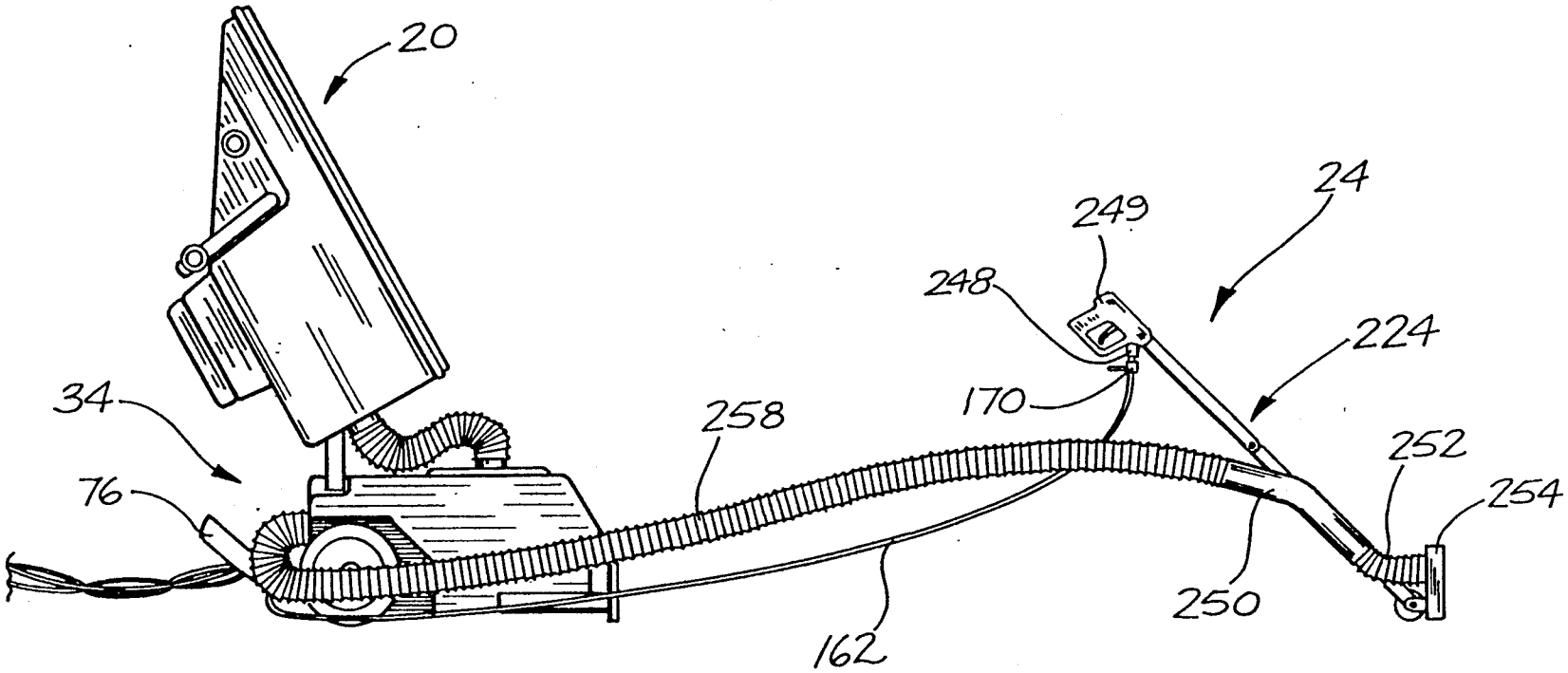
FIG. 12 is a side elevation view of the carpet cleaning apparatus illustrated in FIG. 1, including an auxiliary unit and utilizing a wand attachment.
Figure 14:
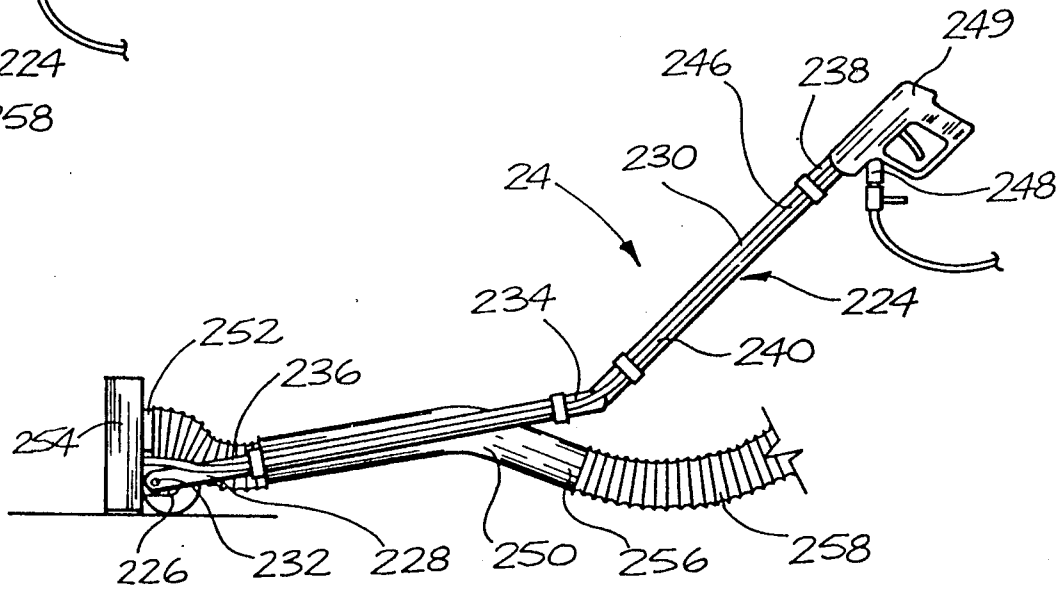
FIG. 14 is a side elevation view of the wand attachment illustrated in FIG. 12, in a second position.
Figure 13:
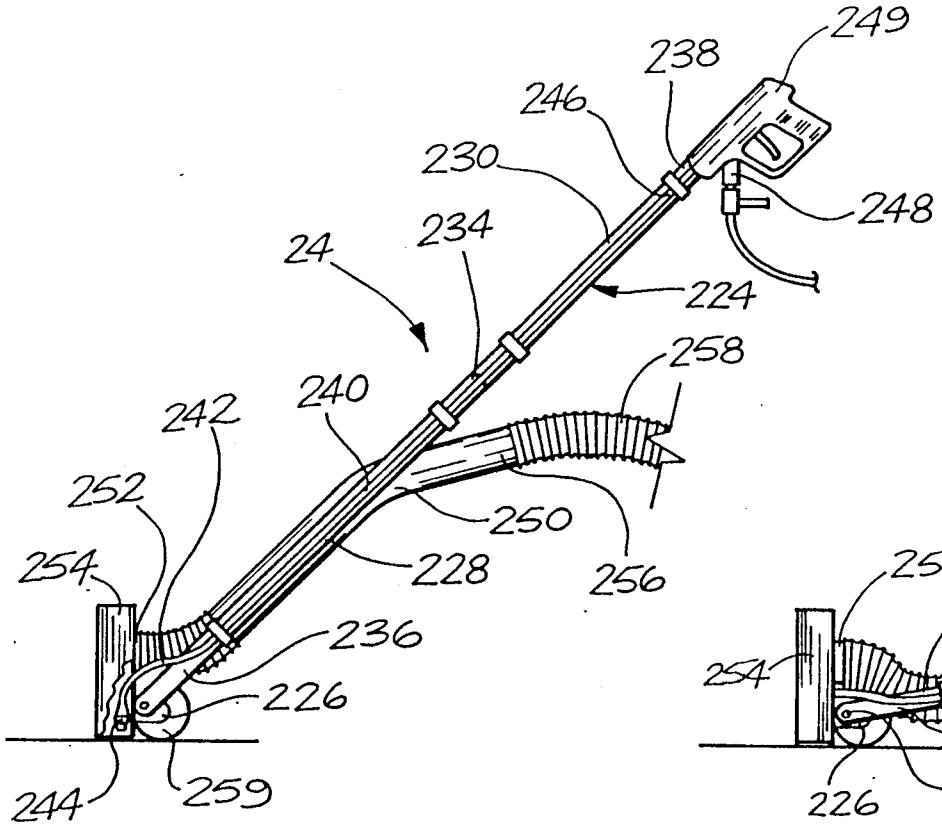
FIG. 13 is a side elevation view of the wand attachment illustrated in FIG. 12, in a first position.

The preferred embodiment will now be described with reference to FIGS. 1 through 14. The preferred embodiment, generally designated by reference numeral 20, is a carpet cleaning apparatus as illustrated in FIGS. 1, and 4 through 12. Carpet cleaning apparatus 20 may be used either with or without auxiliary unit 22 as illustrated in FIGS. 1 through 3 and 12. A wand attachment 24, as illustrated in FIGS. 12 through 14, is provided in order to reach underneath furnishings.

Figure 1:
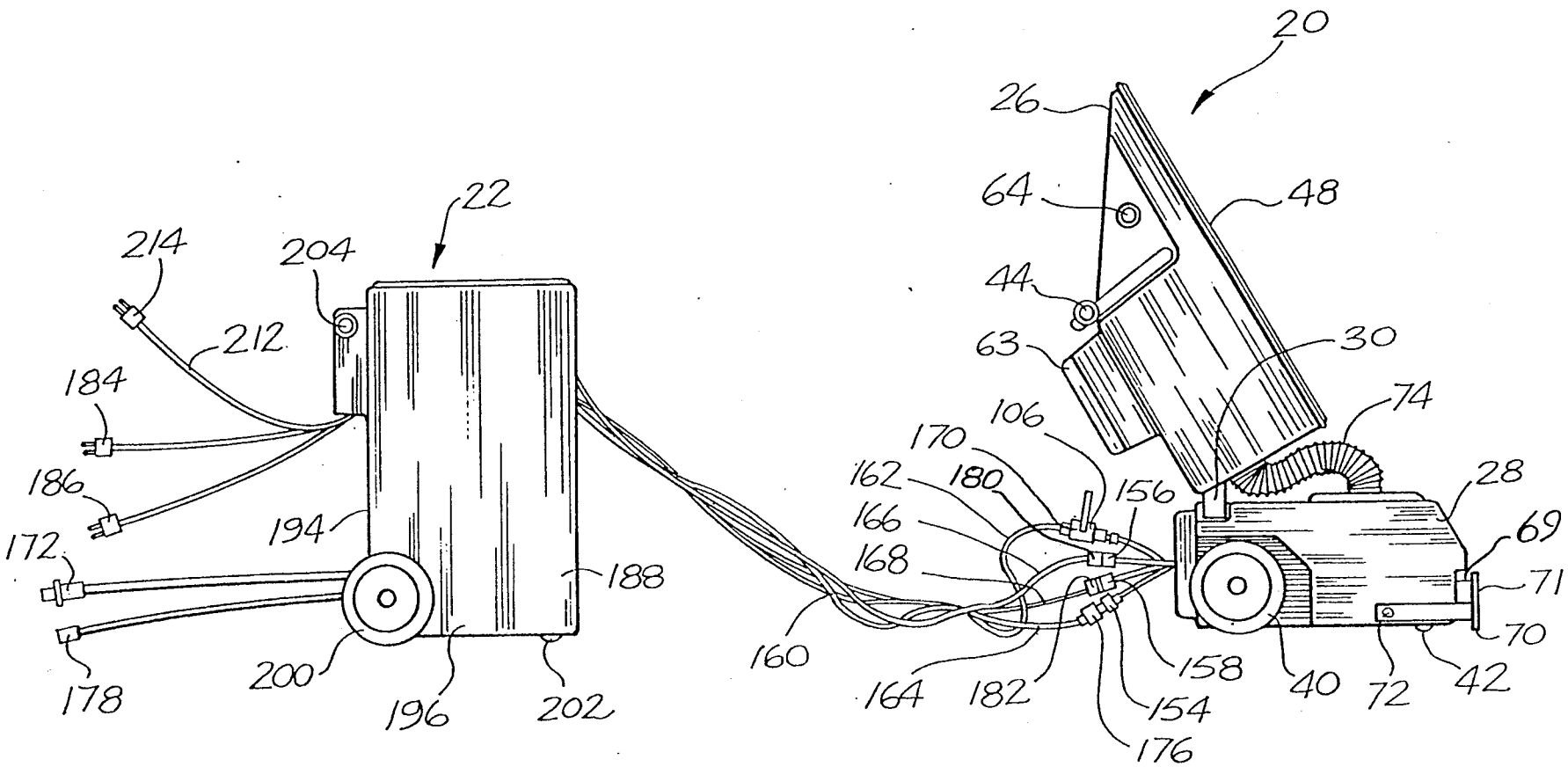
FIG. 1 is a side elevation view of a preferred embodiment of the invention, including an auxiliary unit.
Figure 4:
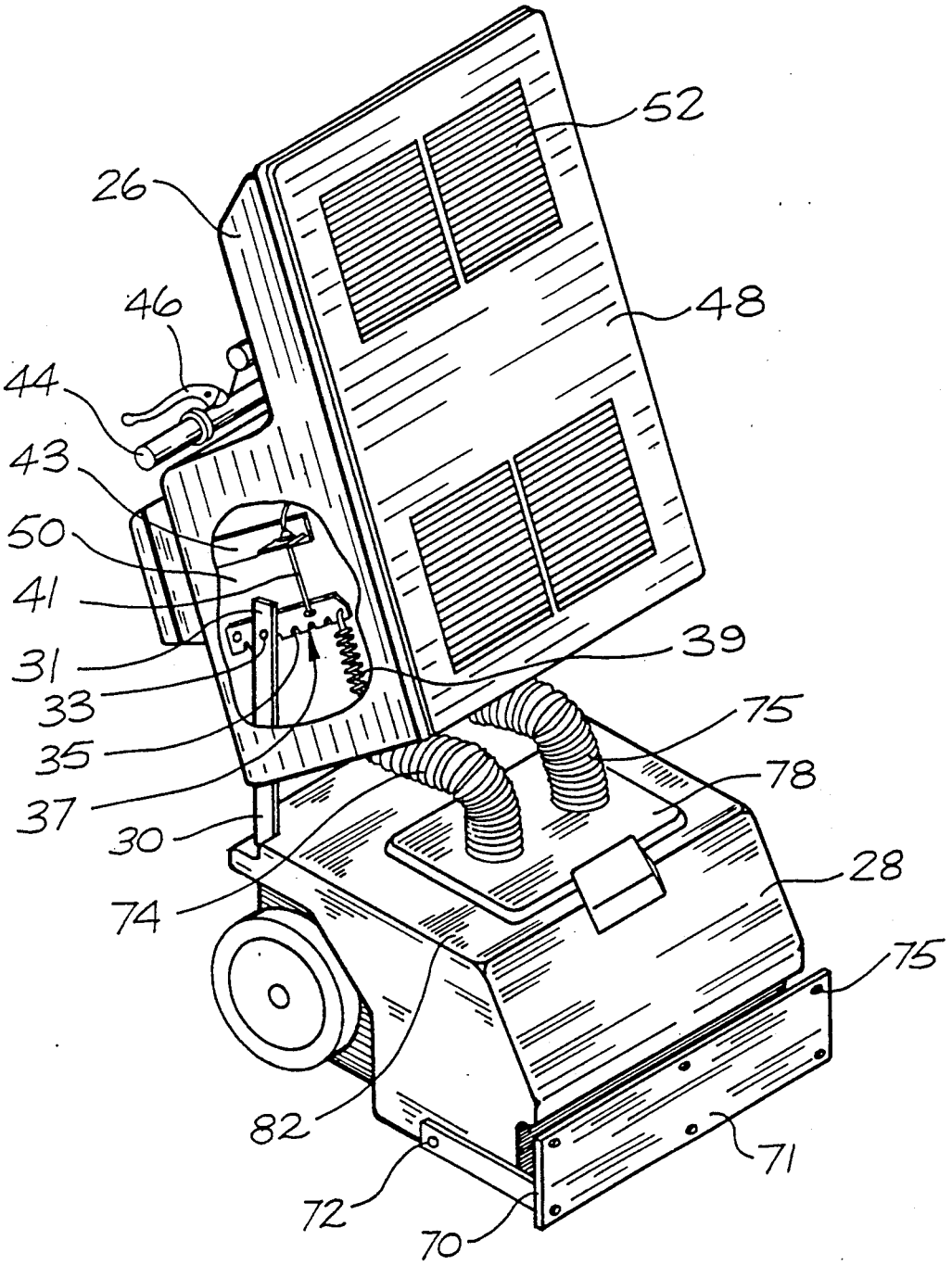
FIG. 4 is a front perspective view of the carpet cleaning apparatus illustrated in FIG. 1.
Figure 5:
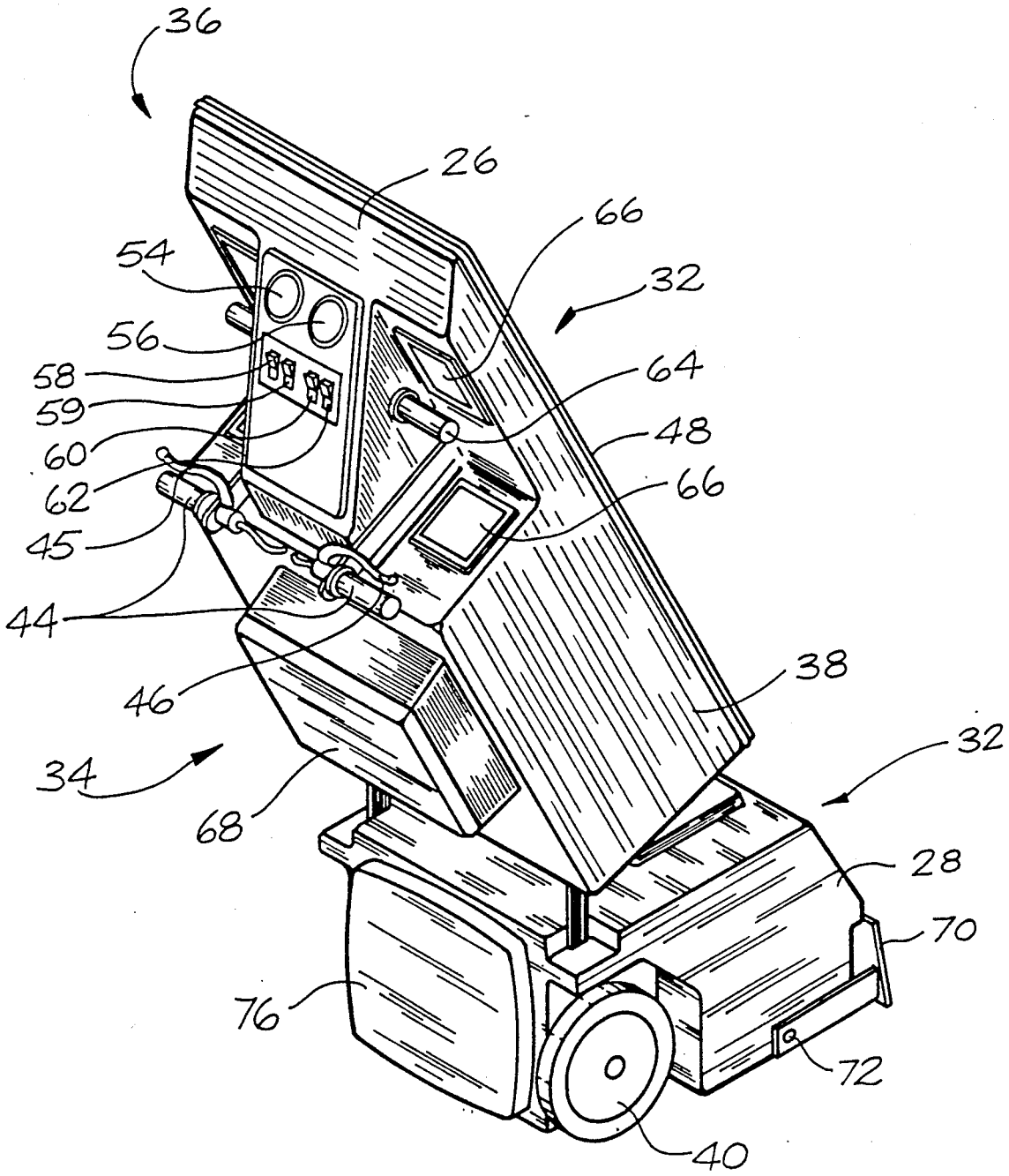
FIG. 5 is a rear perspective view of the carpet cleaning apparatus illustrated in FIG. 1.

Carpet cleaning apparatus 20 is illustrated in FIGS. 4 and 5. Carpet cleaning apparatus 20 has two main components an upper housing 26 and a lower housing 28. Upper housing 26 is secured to lower housing 28 by supports 29 and 30 which are pivotally mounted to lower housing 28. The pivotal movement of supports 29 and 30 permit upper housing 26 to be moved between a stored position and a range of operative positions. In the stored position upper housing 26 is disposed immediately above lower housing 28. In operative position upper housing 26 is at an angle to lower housing 28 as illustrated in FIGS. 1 and 5. The means of adjustment of upper housing 26 is illustrated in FIG. 4. Upper housing 26 has an interior cavity 50 into which supports 29 and 30 extend. An upper end 31 of support 30 has a transversely projecting pin 33. Projecting pin 33 engages a latch arm 35 which is pivotally mounted within interior cavity 50. Latch arm 35 has a series of notches 37 which accommodate pin 33 and provide a number of operative positions. Latch arm 35 is biased by a spring 39 to maintain one of notches 37 in engagement with pin 33 on support 30. A wire 41 extends from latch arm 35 through a guide 43 to an activation mechanism, lever 46, which will hereinafter be further described. For the purpose of this description apparatus 20 can be considered to have a front 32, a back 34 and parallel sides 36 and 38. Lower housing 28 has two sets of wheels 40 and 42 which permit apparatus 20 to be moved along a carpeted surface (not shown). One set of wheels 40 is positioned on opposed sides 36 and 38 adjacent back 34 of lower housing 28. The other set of wheels 42 is positioned on opposed sides 36 and 38 adjacent front 32 of lower housing 28. Set of wheels 40 is approximately three times the diameter of set of wheels 42 to assist in the manoeuvering of apparatus 20. A pair of handles 44 are secured to back 34 of upper housing 26. Secured to handles 44 are levers 45 and 46. Lever 46 is secured to wires 41. The movement of upper housing 26 from a stored position to an operative position is effected by squeezing lever 46 which is mounted on handle 44. The purpose of lever 45 will hereinafter be explained. A door 48 is positioned at front 32 of upper housing 26 to provide access to interior cavity 50. Door 48 has a plurality of vents 52. Positioned at back 34 of upper housing 26 are two chronometer gauges 54 and 56. Gauge 54 is intended to monitor the time spent on a particular cleaning job for billing purposes. Gauge 56 is intended to monitor the duration of hours of operation between maintenance checks. Also positioned at back 34 of upper housing 26 are series of four switches 58, 59, 60, and 62, these switches activate working components which will be hereinafter further described. A second set of handles 64 are positioned at back 34 of upper housing 26 to provide a secondary gripping location for the operator. Air vents 66 are provided at back 34 of upper housing 26. Also positioned at back 34 of upper housing 26 is a storage compartment 68. Secured to front 32 of lower housing 28 is a sandwich blade 70 which serves as a conduit through which the suction force of apparatus 20 is concentrated. Sandwich blade 70 is pivotally mounted on pins 72, and can be adjusted at varying heights for purposes of storage or to adapt to varying thicknesses of carpet pile. A brace 69 holds sandwich blade 70 in a position where it engages the pile of a carpet. Sandwich blade 70 has a face plate 71, which is secured to sandwich blade 70 by screws 75. Extending between upper housing 26 and lower housing 28 are two vacuum hoses 74 and 75, the purpose of which will be hereinafter further described. Two doors 76 and 78 provide access to an interior cavity 80 of lower housing 28; cavity 80 will be described in more detail with respect to FIG. 6. Door 76 is positioned at back 34 of lower housing 28. Door 78 is positioned on top 82 of lower housing 28.

Figure 6:
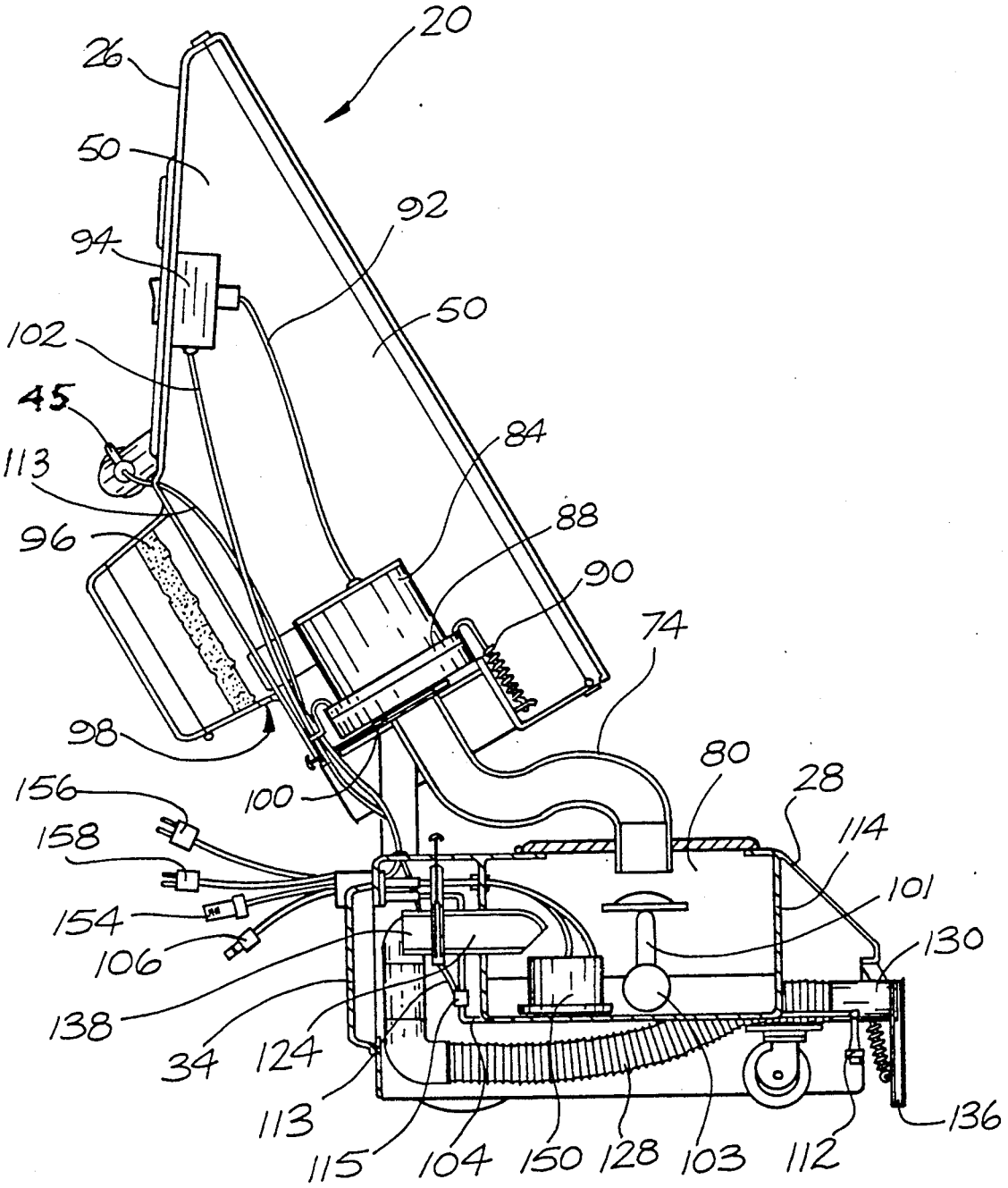
FIG. 6 is a section view of the carpet cleaning apparatus taken of FIG. 1.
Figure 7:
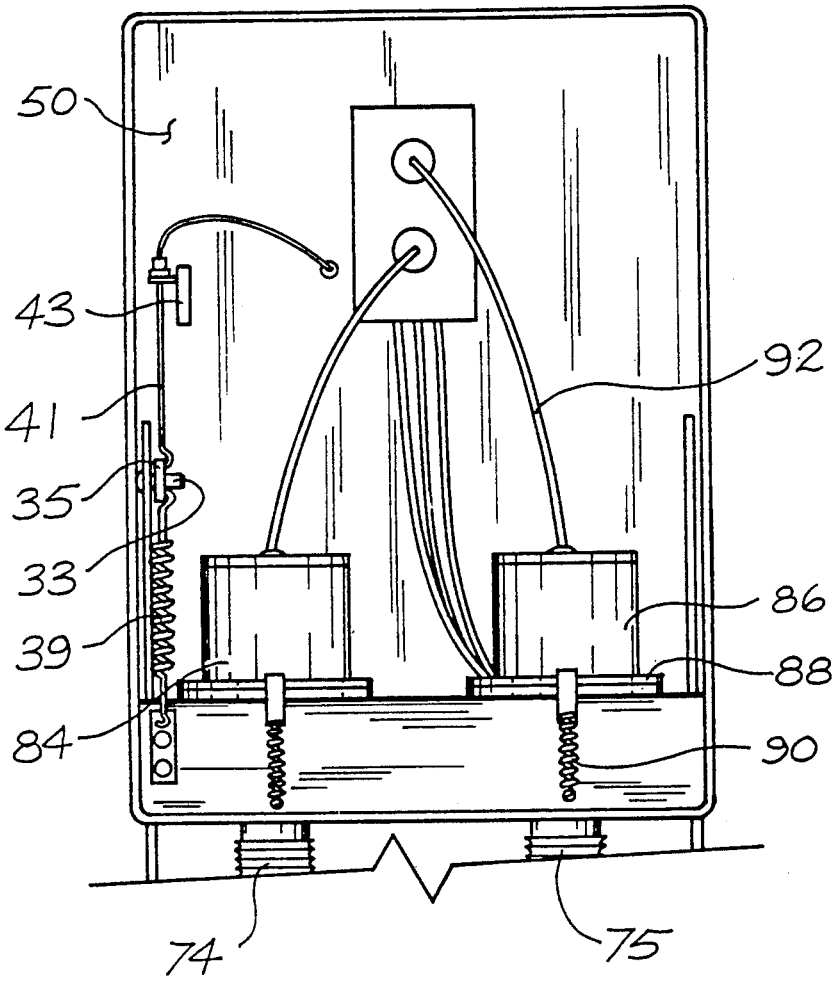
FIG. 7 is a section view of the carpet cleaning apparatus taken of FIG. 6.

Referring now to FIG. 6, interior cavity 50 of upper housing 26 and interior cavity 80 of lower housing 28 are illustrated. Interior cavity 50 is further illustrated in FIGS. 4 and 7. Two vacuum motors 84 and 86 are secured to a mounting bracket 88 within interior cavity 50. The mode of securing vacuum motors 84 and 86 is a spring biased latch 90, which can be released to permit the removal of one of motors 84 or 86. Each of vacuum motors 84 and 86 has a power cable 92 which plugs into a power panel 94. Vacuum hoses 74 and 75 are secured to mounting bracket 88, and coupled to vacuum motors 84 and 86 respectively. Air vents 66 promote the circulation of air within interior cavity 50 upon activation of vacuum motors 84 and 86. Vacuum motors 84 and 86 are mounted within interior cavity 50 in such a manner that the exhaust discharges into a padded foam muffler 96 and then out an exhaust port 98. Vacuum hose 74 has a closure valve 100 which can be used if motor 84 is turned off for tasks where only suction from a single motor 86 is required. The balance of the space within interior cavity 50 is used for storage for stain removers, and other items which are an essential part of a carpet cleaners equipment and which can withstand the heat generated by vacuum motors 84 and 86. Extending from power panel 94 is electrical wiring 102.

Figure 8:
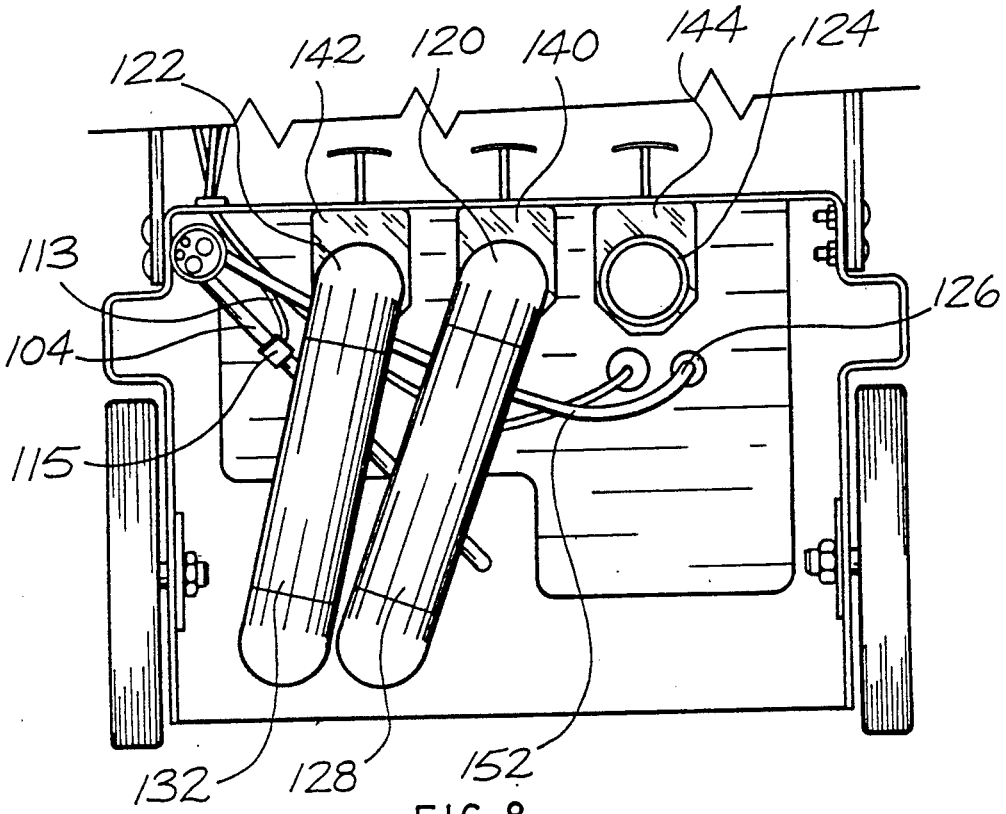
FIG. 8 is a section view of the carpet cleaning apparatus taken of FIG. 6.
Figure 9:
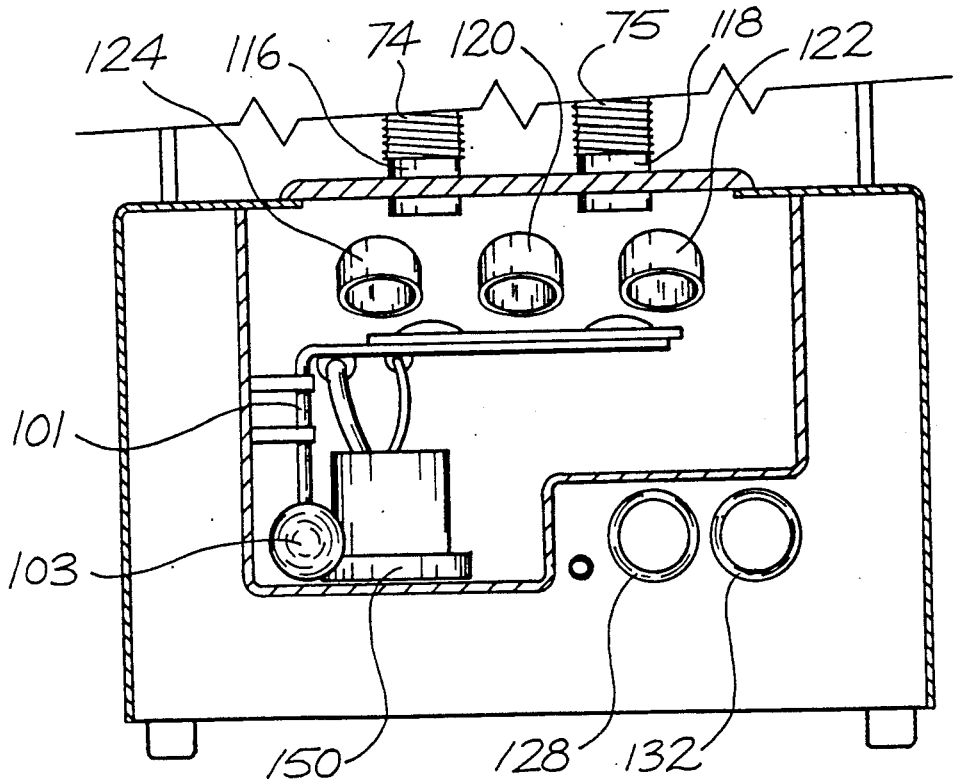
FIG. 9 is a section view of the carpet cleaning apparatus taken of FIG. 6.

Interior cavity 80 of lower housing 28 is illustrated in FIGS. 6, 8, and 9. A water supply conduit 104 extends between back 34 and front 32 of interior cavity 80. Water supply conduit 104 has a coupling connection end 106 which extends passed back 34 of lower housing 28 and a spray jet end 108 which is secured to a spray head 110 having a plurality of spray jets 112. Spray jets 112 are directed downward in order that fluids may be injected into the pile of a carpet. A discharge tank 114 is secured within interior cavity 80. Discharge tank 114 has two suction ports 116 and 118, three fluid inlets 120, 122, 124 and a fluid outlet 126. Suction ports 116 and 118 are connected to vacuum hoses 74 and 75, respectively, as best illustrated in FIG. 9. A Suction conduit 128 extends from fluid inlet 120 to a first port 130 of sandwich blade 70. A suction conduit 132 extends from fluid inlet 122 to a second port 134 of sandwich blade 70. Ports 130 and 134 connect with an interior suction passage 136 to enable suction from suction conduits 128 and 132 to draw fluids from the surface of a carpet. Referring to FIG. 6, a floating valve assembly 101 is positioned within discharge tank 114. As the water level in discharge tank 114 rises a float portion 103 of valve assembly 101 floats upward to seal off suction ports 116 and 118 thereby preventing fluids from being drawn through vacuum hoses 74 and 75 into vacuum motors 84 and 86. Ports 130 and 134 of sandwich blade 70, together with spray head 110 and spray jets 112 are illustrated in FIG. 10. Referring to FIG. 6, a wire 113 extends from lever 45 to a flow valve 115 on conduit 104 which leads to spray head 110 and spray jets 112. By squeezing lever 45 wire 113 opens flow valve 115 causing fluids to flow along conduit 104 to spray jets 112. Fluid inlet 124 extends outwardly from discharge tank 114 to form coupling connection 138. Fluid inlets 120, 122 and 124 have closure valves 140, 142, and 144, respectively. Referring to FIG. 11, each of closure valves 140, 142, and 144 consist of a recessed panel 146 which can be moved to obstruct the respective one of fluid inlets 120, 122, and 124 by manipulation of an attached handle 148. A sump pump 150 is disposed in discharge tank 114 to permit fluids in discharge tank 114 to be pumped out of fluid outlet 126. A discharge conduit 152 extends from fluid outlet 126 passed back 34 of lower housing 28 terminating in a coupling connection 154. Electrical wiring 102 extends passed back 34 of lower housing 28 and terminates in two plugs 156 and 158. Referring to FIG. 1, apparatus 20 is connected to power, water, and drain (not shown) by a braided umbilical cord 160. Braided umbilical cord 160 has incorporated in it a water supply hose 162, a discharge water return hose 164, and two power cables 166 and 168. Water supply hose 162 has one end 170 which is connected to coupling connection end 106 of water supply conduit 104. Coupling connection 106 has incorporated within it a valve in order to shut off the flow of water through water supply conduit 104. The other end 172 of water supply hose 162 is inteded to be connected to the water service in the building being cleaned. Discharge water return hose 164 has one end 176 which is connected to coupling connection 154 of discharge conduit 152. The other end 178 of discharge water return hose 164 is intended to be placed adjacent a drain in order that discharge water will flow down the drain. Power cables 166 and 168 have ends 180 and 182 which connect to plugs 156 and 158, respectively. The other ends 184 and 186 are intended to be connected to the power in the building being cleaned.

In order to use carpet cleaning apparatus 20 a connection must be made with braided umbilical cord 160. In order to accomplish this plug 156 must be connected to end 180 of electrical power cable 166 and plug 158 must be connected to end 182 of electrical power cable 168. Opposed ends 184 and 186 of electrical power cables 166 and 168, respectively, must then be connected to the electrical service of the building (not shown). Similarly, coupling connection 106 of water supply conduit 104 must be coupled to end 170 of water supply hose 162. Opposed end 172 of water supply hose 162 being connected to the water service of the building (not shown). Coupling connection 154 of discharge conduit outlet 152 must be coupled to end 176 of discharge hose 164. Opposed end 178 of water discharge hose 164 is placed in a sink, or adjacent a drain of the building water service (not shown). The water pressure of the building water service provides water under pressure via water supply hose 162 to water supply conduit 104. By squeezing upon lever 46, wire 41 lifts latch arm 35 disengaging one of notches 37 from pin 33 and permitting upper housing 26 of apparatus 20 to be moved by pivoting supports 30 from a stored position directly over lower housing 28 to one of the operative positions. By squeezing upon lever 45, water may be fed to spray head 110 of water supply conduit 104 where it is injected into the carpet by spray jets 112. Switches 58, 59, 60, and 62 may then be turned to an operative position. Switch 58 activates sump pump 150. Switch 59 activates vacuum motor 84. Switch 60 activates vacuum motor 86. Switch 62 activates all auxiliary systems from which the operator may chose to run a radio and other optional equipment. When vacuum motors 84 and 86 are activated a suction force is created which instantly builds a vacuum within vacuum hoses 74 and 75, discharge tank 114 and suction conduits 128 and 132. Suction conduits 128 and 132 are secured to ports 130 and 134, respectively, of sandwich blade 70. This parallel hook up of vacuum motors 84 and 86, together with parallel suction conduits 128 and 132 creates a suction force within interior suction passage 136 of sandwich blade 70 which is greater than the force which could be obtained using any known configuration of multiple motors in series with a single vacuum hose. The force of the suction created in interior suction passage 136 draws fluids from the surface of the carpet (not shown) via suction conduits 128 and 132 into fluid inlets 120 and 122, respectively of discharge tank 114. As discharge tank 114 fills with fluids sump pump 150 draws fluids from discharge tank 114 pumping them out fluid outlet 126, through discharge conduit 152 and via discharge hose 164 to the drain (not shown).

Figure 3:
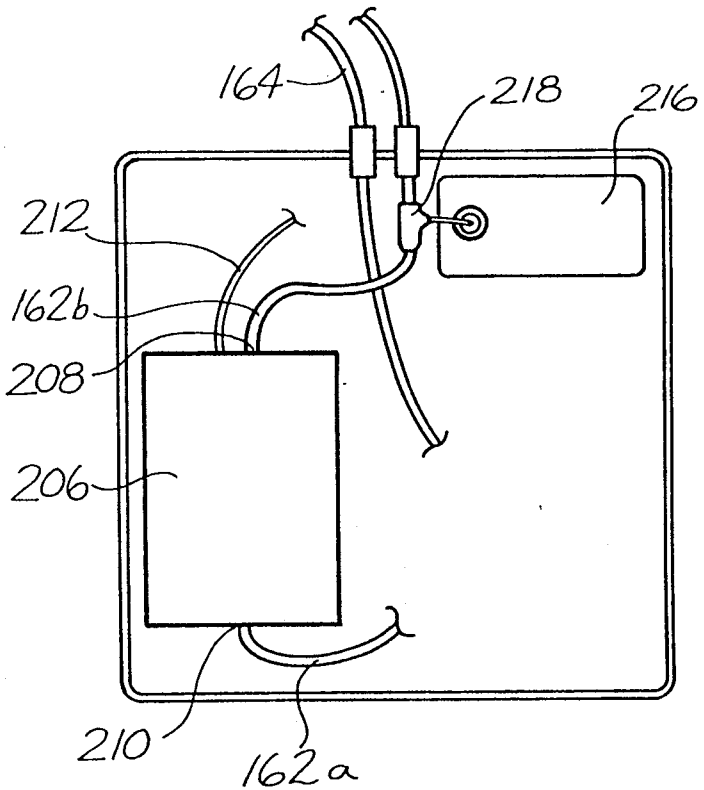
FIG. 3 is a section view taken FIG. 1.
Figure 2:
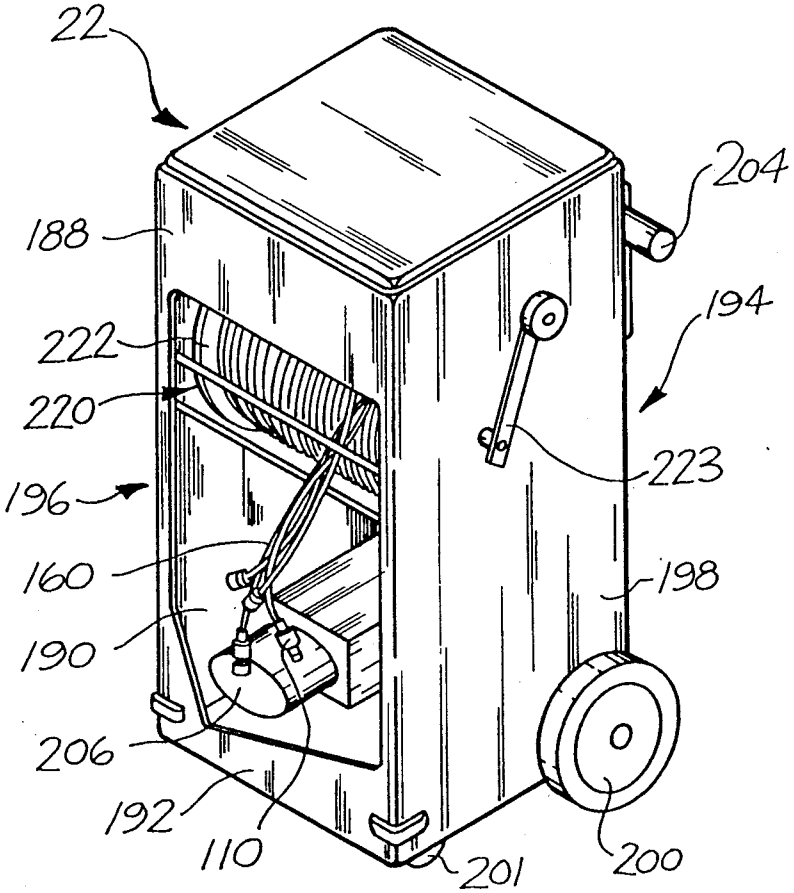
FIG. 2 is a perspective view of an auxiliary unit to the preferred embodiment of the invention illustrated in FIG. 1.

The operation of apparatus 20 can be improved by coupling apparatus 20 to an auxiliary unit 22 illustrated in FIGS. 1 through 3. Auxiliary unit 22 consists of a housing 188 having an interior cavity 190. For the purpose of our description housing 188 can be considered to have a front 192, a back 194 and opposed sides 196 and 198. Two sets of wheels 200 and 201, are rotatably mounted to housing 188 in order to permit housing 188 to be manoeuvered into position adjacent the water service of a building. Wheels 200 are positioned at back 194 of housing 188 on opposed sides 196 and 198. Wheels 201 are positioned at front 192 of housing 188 on opposed sides 196 and 198. Wheels 200 and 201 are similar to wheels 40 and 42 of apparatus 20. Handles 204 are provided at back 194 of housing 188 to assist in manipulating housing 188 into position. A pump 206 is positioned within interior 190 of housing 188. Pump 206 is capable of producing water pressure in excess of 150 pounds per square inch, and preferably can produce pressures approaching 1000 pounds per square inch. Referring to FIG. 3, pump 206 has an inlet 208 and an outlet 210. Pump 206 is along the path of water supply hose 162. For the purpose of our description the water supply hose 162 can be considered to consist of two segments when apparatus 20 is used with ancillary unit 22. Segment **162*b* extends from end 172 to inlet 208 of pump 206. Segment 162*a* extends from outlet 210 of pump 206 to end 170. Power is supplied to pump 206 by electrical power cable 212, which terminates in a plug connection 214. A chemical reservoir 216 with a venturi valve connection 218 is disposed within interior cavity 190 of housing 188. Venturi valve connection 218 is secured to segment 162*b* of water supply hose 162. A hose and cable support 220 is rotatably mounted within interior cavity 190 of housing 188. Support 220 is in the form of a drum 222 upon which is wound braided cord 160. Drum 222 is secured to a handle 223 which may be used for winding up braided cord 160**.

In order to use auxiliary unit 22, the unit is wheeled into the work area adjacent a sink (not shown). Braided cord 160 is connected as previously described. However, upon activation of pump 206 water is delivered via water supply hose 162 and water supply conduit 104 to spray jets 112 under pressures which greatly exceed pressures otherwise available through the building water service. This water pressure enhances the force with which the water is injected into the carpet and makes the cleaning action more effective. Where the use of cleaning chemicals is desired, wet or dry chemicals from chemical reservoir 216 may be drawn by the flow of the water passed venturi valve 218 into the fluid stream. Cable support 220 is capable of storing 100 feet of braided cord 160. As apparatus 20 is moved to the far side of a room braided cord 160 is fed out by the rotation of drum 222. When the cleaning of the carpet has been completed braided cord 160 may be drawn back on drum 222 by turning handle 223.

It will be apparent to one skilled in the art that apparatus 20 is well suited for cleaning open stretches of carpet, but it can not be used for cleaning under furnishings. For cleaning under furnishings a special wand attachment 24 is provided, as illustrated in FIGS. 12 through 14. Wand attachment 24 consists of an articulated shaft 224. Shaft 224 has three sections 226, 228, 230. Section 226 is pivotally connected to section 228 at connection 232. Section 228 is pivotally connected to section 230 at connection 234. For the purpose of this description shaft 224 can be considered to have a first end 236 and a second end 238. Pivotal connection 232, connecting section 226 to section 228, is positioned adjacent first end 236 of shaft 224. Pivotal connection 234, connection section 228 to section 230, is spaced from second end 238 of shaft 224. A fluid conduit 240 is secured to shaft 224. Conduit 240 has a first end 242 at the first end 236 of shaft 224. Spray jets 244 are secured to end 242 of conduit 240. Conduit 240 has a second end 246 which has a coupling 248. Second end 246 of conduit 240 has a hand control valve 249 to control the flow of fluids into conduit 240. A suction conduit 250 is secured to shaft 224. Suction conduit 250 has a first end 252 disposed at first end 236 of shaft 224. Suction conduit 250 has a second end 256 which may be attached to a length of vacuum hose 258. A sandwich blade 254 is secured to first end 236 of shaft 224. Sandwich blade 254 has positioned within it spray jets 244 and first end 252 of suction conduit 250. A pair of wheels 259 are rotatably mounted at first end 236 of shaft 224.

In order to use wand attachment 24, door 76 at back 34 of apparatus 20 must be opened to provide access to coupling connection 138 of fluid inlet 124. Handle 148 on valve 144 must be pulled out to move recessed panel 146 to a position where it no longer restricts fluid inlet 124. Vacuum hose 258 is then secured to coupling connection 138. The opposed end of vacuum hose 258 is secured to second end 256 of suction conduit 250. Valves 140 and 142 should be closed to restrict the flow into fluid inlets 120 and 122. End 170 of water supply hose 162 must be connected to coupling 248 at second end 246 of conduit 240. By squeezing hand control valve 249 fluids are allowed to flow along conduit 240 to spray jets 244. As spray jets 244 are housed within sandwich blade 254, the operator need not worry about water splashing onto surrounding furnishings. Water is injected under pressure into the carpet. The force of vacuum motors 84 and 86 then draws the water from sandwich blade 254 into first end 252 and along suction conduit 250, along the length of vacuum hose 258 and into fluid inlet 124 of discharge tank 114. The unique feature of wand attachment 24 is articulated shaft 224. Articulated shaft 224 can assume a number of positions to provide access to hard to reach places. FIG. 13 shows shaft 224 in a conventional position with joint 232 bent to place sections 226 and 228 at an angle with respect to each other while sections 228 and 230 remain aligned on a common plane. FIG. 14 shows shaft 224 in a position where it can reach underneath furnishings as joint 234 is bent to place sections 228 and 230 at an angle with respect to each other while sections 226 and 228 remain substantially aligned on a common plane.

Apparatus 20 has some secondary features which are intended to provide some time savings for the operator. One of the problems with the carpet cleaning business is the boredom which can develop when a person working alone is required to clean the entire floor of an office building. The proto-type of apparatus 20 comes equipped with an auxiliary power switch 62 which permits an am/fm radio to be operated. Everytime the operator must leave his machine valuable time is lost. For this reason apparatus 20 has sufficient storage capacity to carry spot removers, refreshments for the operator, and other necessary materials. Apparatus 20 is constructed in order that it may be serviced by persons without technical training. If one of motors 84 or 86 were to cease operating, the defective one of motors 84 or 86 could be removed and replaced by simply unplugging it from power panel 94 and releasing spring biased latch 90. Sump pump 150 and pump 206 can similarly be replaced by persons without technical training. Sandwich blade 70 is of unique design as face plate 71 can be removed by loosening screws 75. Sandwich blades 70 traditionally have taken a lot of abuse when they strike the legs of furnishings or low lying objects. In traditional construction entire blade 70 must be discarded, in the present invention face plate 71 may be removed and straightened or replaced as required. Apparatus 20 can be used as a dry vacuum, if desired, merely by placing a dry filter in discharge tank 114. A build up of excess soap suds sometimes causes discharge tank 114 to overflow. In the event this should happen, switches 58 and 59 are immediately accessible to the operator to shut down motors 84 and 86, whereas in traditional construction the operator would have to walk 30 feet or more to shut off the unit. During the period of delay dirty discharge water could be spraying onto the walls causing irreparable harm to wall paper, paintings and furnishings. Upper housing 26 and lower housing 28 of apparatus 20 are constructed of fiberglass to make it lightweight. The lightweight assists in maneuverability, as compared to traditional steel construction. The fiberglass construction also reduces the possibility of an operator working on a wet carpet receiving a shock. Gauge 56 assists the operator in keeping track of engine wear, in order that preventative maintenance may be performed before problems occur. Gauge 54 keeps track of working time to assist in accuracy of billing.

It will be apparent to one skilled in the art that having chemical reservoir 216 connected to water supply hose 162 by venturi valve 218 eliminates the need to have a separate tank in which water and chemicals are mixed. It will be apparent to one skilled in the art that a continuous discharge of dirty water flows through discharge hose 164, thereby eliminating the need for continuous stops to empty discharge tank 114. It will be apparent to one skilled in the art that the running of vacuum motors 84 and 86 in a parallel configuration creates a suction force that far exceeds that of units which have previously been available. It will be apparent to one skilled in the art that the use of auxiliary unit 22 enhances the water pressure available and provides an acceptable support for handling as much as 100 feet of braided cord 160.

THE EMBODIMENTS OF THE INVENTION IN WHICH AN EXCLUSIVE PROPERTY OR PRIVILEGE IS CLAIMED ARE DEFINED AS FOLLOWS:

1. A carpet cleaning apparatus, comprising:

a. a housing having a lower surface and an interior cavity;

b. means for moving the housing along a carpet secured adjacent to the lower surface of the housing;

c. a water supply conduit secured to the housing, the conduit having a first end whereby the conduit may be coupled to a water supply and a second end with spray jets whereby fluids may be discharged onto a carpet;

d. a discharge tank secured within the interior cavity of the housing, the discharge tank having two suction ports, and two fluid inlets;

e. two suction conduits, each suction conduit having a first end communicating with one of the fluid inlets of the discharge tank and a second end disposed adjacent the lower surface of the housing; and f. two suction motors secured in the interior cavity of the housing spaced from and positioned above the discharge tank, each of the suction motors communicating with one of the suction inlets of the discharge tank through a length of vacuum hose such that a vacuum is created within the discharge tank and the suction conduits by the cumulative suction force of the two suction motors thereby drawing fluids from the surface of a carpet via the suction conduits into the fluid inlets of the discharge tank.

2. A carpet cleaning apparatus, comprising:

a. a primary unit, comprising:

i. a housing having a lower surface and an interior cavity;

ii. means for moving the housing along a carpet secured adjacent to the lower surface of the housing;

iii. a water supply conduit secured to the housing, the conduit having a first end whereby the conduit may be coupled to a water supply and a second end with spray jets whereby fluids may be discharged onto a carpet;

iv. a discharge tank secured within the interior cavity of the housing, the discharge tank having two suction ports, two fluid inlets, and a fluid outlet;

v. a sump pump disposed in the discharge tank whereby fluids in the discharge tank are pumped out of the fluid outlet to a discharge hose which discharges into a drain of a building water service;

vi. two suction conduits, each suction conduit having a first end communicating with one of the fluid inlets of the discharge tank and a second end disposed adjacent the lower surface of the housing; and vii. two suction motors secured in the interior cavity of the housing spaced from and positioned above the discharge tank, each of the suction motors communicating with one of the suction inlets of the discharge tank through a length of vacuum hose such that a vacuum is created within the discharge tank and the suction conduits by the cumulative suction force of the two suction motors thereby drawing fluids from the surface of a carpet via the suction conduits into the fluid inlets of the discharge tank; and b. an auxiliary unit, comprising:

i. an auxiliary housing having an interior cavity;

ii. a pump capable of producing water pressure in excess of 150 pound per square inch disposed within the interior cavity of the auxiliary housing, the pump having an inlet and an outlet;

iii. a water connection hose having a first end communicating with the inlet of the pump and a second end adapted to be secured to a building water service such that water is provided from the water service to the inlet;

iv. a second water connection hose having a first end communicating with the outlet of the pump and a second end adapted for coupling with the water supply conduit of the primary unit; and v. a hose and cable support mounted within the interior of the auxiliary housing, such that the second water connection hose, the discharge hose and electrical power cables may be wound around the support.

3. A carpet cleaning apparatus as defined in claim 2, the water supply hose, the discharge hose and electrical power cables being braided to form a composite cable.

4. A carpet cleaning apparatus as defined in claim 2, the hose and cable support being rotatably mounted.

5. A carpet cleaning apparatus as defined in claim 2, a chemical reservoir with a venturi valve being disposed within the housing of the auxiliary unit and connected to the water supply hose whereby chemical cleaners may be added to the water supply.

* * * * *